United States Patent [19]

Muijs

[11] 4,111,819

[45] Sep. 5, 1978

[54] TEXTILE FIBER LUBRICANT

[75] Inventor: Herman M. Muijs, Amsterdam, Netherlands

[73] Assignee: Shell Oil Company, Houston, Tex.

[21] Appl. No.: 850,877

[22] Filed: Nov. 14, 1977

[51] Int. Cl.[2] ..... D06M 13/18

[52] U.S. Cl. ..... 252/8.9; 8/115.6; 252/8.6; 252/52 A; 427/390 R; 428/290

[58] Field of Search ..... 252/8.9, 8.6, 52 A; 8/115.6; 427/390; 428/290

[56] References Cited

U.S. PATENT DOCUMENTS

| | | | |
|---|---|---|---|
| 2,425,755 | 8/1947 | Roberts et al. | 252/8.9 UX |
| 2,690,426 | 9/1954 | Jefferson et al. | 252/8.9 |
| 2,838,455 | 6/1958 | Tompkins | 252/8.6 |
| 3,338,830 | 8/1967 | Stokes et al. | 252/8.9 |
| 3,836,496 | 7/1974 | Dickson | 8/115.6 |
| 4,019,990 | 4/1977 | Marshall et al. | 252/8.9 |
| 4,054,634 | 10/1977 | Marshall et al. | 252/8.9 |

*Primary Examiner*—William E. Schulz
*Attorney, Agent, or Firm*—Ronald R. Reper

[57] ABSTRACT

Textile fiber lubricants are disclosed comprising a major amount of (1) the reaction product of (a) at least one $C_1$ to $C_{10}$ alcohol, or (b) at least one $C_2$ to $C_4$ alkylene oxide with (c) at least one $C_2$ to $C_4$ alkylene oxide, and a minor amount of a polymer of an ethylenically unsaturated carboxylic acid.

11 Claims, No Drawings

TEXTILE FIBER LUBRICANT

BACKGROUND OF THE INVENTION

The invention relates to novel textile lubricating oil compositions, to a process for treating or oiling textile fibers using such compositions and with the treated or oiled textile fibers so prepared.

Lubricating oils have been used in the processing of textile fibers for many years. Usually the lubricating oils are mineral oils but there is an increasing tendency to replace such oils by synthetic oils.

One textile process in which lubricating oils have been applied is the winding of yarns, e.g. continuous filament yarns onto cones. Such cones are then used in knitting processes. In such processes the yarn is wound at high speeds, e.g. from 300 to 1,000 meters/minute, onto the cone. Before being wound the yarn passes over a roller, usually described as a lick roller, which is partly immersed in a bath of the lubricating oil, by which means the yarn becomes lubricated or oiled. The lubricating oils used in this process are sometimes described as coning oils or knitting oils and the process is sometimes described as coning. Further information on coning oils may be obtained from the Book of Papers for the 13th Canadian Textile Seminar, 1972, pages 68 to 73.

Coning oils should preferably have the following characteristics. They should be good lubricants i.e. produce low yarn/yarn and yarn/yarn guide (metal, ceramic) friction; they should be water-soluble or emulsifiable in order that they may be scoured or washed from the final textile articles and they should be non-corrosive, non-toxic, biodegradable and physically and chemically stable. A further desirable characteristic which is now receiving increasing attention is that they should be non-splashing or non-slinging. Splashing or slinging is a phenomenon observed during the high speed winding of yarns which results in oil droplets being "slung" off the yarns immediately after they loose contact with the lubricating rollers. Such oil droplets fall onto the winding machine and the flow which, apart from resulting in a loss of oil, endangers the operators and increases costs as a result of the necessary cleaning operation.

SUMMARY OF THE INVENTION

I have now discovered a lubricating composition which has the desirable characteristics required for a coning oil. In particular the lubricating oil compositions of the present invention are substantially non-splashing and are water-soluble.

According to this aspect of the present invention a lubricating oil comprises a major proportion of an ether of formula:

$$R{-}O\,{+}C_mH_{2m}{-}O{+}_xH$$

wherein

R is a $C_1$ to $C_{10}$ alkyl group, $m$ is an integer of from 2 to 4, and $x$ is an integer of from 2 to 20;

and a minor proportion of a polymer of an ethylenically unsaturated carboxylic acid.

According to another aspect of the present invention a process for treating or oiling textile fiber comprises contacting the textile fibers with a lubricating oil composition as described herein.

DESCRIPTION OF PREFERRED EMBODIMENTS

Although the lubricating oil compositions may be used in various textile processes, for example carding and spinning processes, they are particularly useful in coning processes. According to this preferred aspect of the present invention the textile fibers are contacted with the composition during the winding thereof onto cones. For example the textile fibers or yarns are wound onto cones by passing the fibers or yarns over a roller which is partly immersed in a lubricating oil composition. Alternatively the composition may be applied to the fibers or yarns during the winding thereof onto cones by nozzle-type applicators. Before the yarn is treated with the coning oil it is conventional practice to apply a texturizing treatment to improve the bulk thereof. The yarn is suitably in the form of continuous filaments and the process is particularly suitable for treating texturized continuous filament yarns of synthetic material such as polyester or nylon. Usually the amount of lubricating oil composition picked up by the yarn is between 2 and 5%w based on the weight of the yarn.

The lubricating oil components of the compositions of the present invention are suitably prepared by reacting one or more $C_1$ to $C_{10}$ alcohols, or a $C_2$ to $C_4$ alkoxylate thereof, with one or more $C_2$ to $C_4$ alkylene oxides i.e. ethylene oxide, propylene oxide or butylene oxide or mixtures thereof. Preferred components are those derived from $C_1$ to $C_4$ alcohols, i.e. compounds of the above formula wherein R is $C_1$ to $C_4$, and particularly those derived from methanol, ethanol or mixtures thereof. Preferred components are those derived from ethylene oxide, i.e. compounds of the above formula wherein $m$ is 2. Preferably the amount of $C_2$ to $C_4$ alkylene oxide is such that $x$ has an average value of from 2.5 to 10, more preferably of from 3 to 8. Usually the alkoxylation product is a mixture of different chain length alkoxylates which may be separated into various fractions if desired.

An anti-splashing agent is also present in the compositions of the present invention. It should be pointed out that the function of the anti-splashing agent is not to thicken the lubricating oil but to impart to the oil the property of stringyness or pituituosness. This property prevents oil droplets being slung off the yarn during the oiling or coning process.

As stated hereinbefore the anti-splashing agent is a polymer of an ethylenically unsaturated carboxylic acid. Such polymers may be those derived from one or more ethylenically unsaturated monocarboxylic acids such as acrylic acid, methacryic acid i.e. acids having the general formula:

$$C_nH_{2n-1}COOH,$$

and/or one or more ethylenically unsaturated dicarboxylic acids such as fumaric acid or maleic acid i.e. acids having the general formula:

$$C_nH_{2n-2}(COOH)_2$$

wherein, in both formulae, $n$ is a whole number of from 2 to 10, preferably of from 2 to 6.

The aforesaid polymers may be homopolymers or copolymers i.e. polymers of an ethylenically unsaturated carboxylic acid and one or more different monomers. Examples of different monomers include unsaturated monomers such as ethers e.g. $C_1$ to $C_4$ vinyl ethers, esters e.g. $C_1$ to $C_4$ esters of acrylic acid or methacrylic acid, amides e.g. acrylic acid amides, salts e.g. acrylic acid salts, and olefins e.g. ethylene. The only restriction on the type of monomers used is that the polymer should be sufficiently soluble in the lubricating oil component. The preferred comonomers are esters, in particular $C_1$ to $C_4$ (meth)acrylic esters and/or $C_1$ to $C_4$ vinyl ethers.

The polymers may be prepared directly i.e. by polymerizing an ethylenically unsaturated carboxylic acid, optionally in the presence of other monomers, or indirectly i.e. by polymerizing an ethylenically unsaturated carboxylic acid group precursor, e.g. maleic anhydride, again optionally in the presence of other monomers, followed by conversion of the carboxylic acid group precursor, e.g. by hydrolysis, into carboxylic acid groups. This conversion may take place before or after the polymer is added to the lubricating oil component.

Suitable polymers are those having an average molecular weight between about $4 \times 10^4$ and about $2 \times 10^7$.

Suitable polymers are copolymers of maleic acid and a $C_1$ to $C_4$ vinyl ether and may be represented by the following formula:

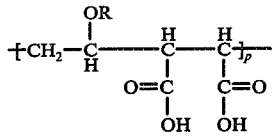

wherein R is a $C_1$ to $C_4$ alkyl group, preferably methyl, and $p$ is an integer. Such polymers may be added to the lubricating oil component in the form of its anhydride which is then hydrolyzed, at least partially, e.g. by adding an alkali-metal hydroxide. Consequently, most of the anhydride groups will be converted to acid groups and some of the acid groups may be in the form of carboxylic acid salt groups. Polymers of these types are commercially available under the trade name GANTREZ (ex GAF). Specific examples include GANTREZ AN 169 and GANTREZ HY-H.

Other suitable polymers consist mainly of the recurring unit of the formulae:

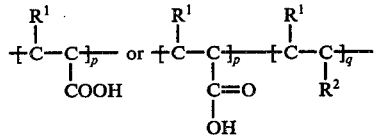

wherein $R^1$ is H or methyl, $R^2$ is a carboxylic amide or ester group, and $p$ and $q$ are integers. At least some of the acid groups may be present as carboxylic acid salt e.g. sodium groups. Preferred polymers of this type are polyacrylic acid or polymethacrylic acid or copolymers of acrylic or methacrylic acids with a $C_1$ to $C_4$ ester of acrylic or methacrylic acid. Polymers of these types are commercially available under the trade name ROHAGIT (Ex Rohm & Haas) and VISCALEX (ex Allied Chemicals). Specific examples include ROHAGIT S, NV, MV or HV and VISCALEX EM 15.

The aforesaid anti-splashing agents may be added to the lubricating oil in the form of powders, aqueous emulsions, solutions or gels. Suitably the amount of anti-splashing agent added is from 0.01 to 5%w, preferably from 0.05 to 2.5%w, based on the weight of the ether. Other additives may be present in the lubricating oil compositions. Additional additives include water, which may be necessary if clear solutions are desired, in amounts of from 1.0 to 25%w, based on the weight of the lubricating oil composition; corrosion inhibitors, e.g. sodium benzoate, sodium salicylate, a salt of n-$C_{12}$/$C_{14}$-beta-propionic acid, a lauroylsarcosine, or a mono- or polyalkyl phosphate, phosphite of phosphonate in amounts of from 0.05 to 1.5%w, based on the weight of the lubricating oil composition; and/or antioxidants e.g. phenolic compounds such as di-tert-butyl cresol, diphenylolpropane and alkylated diphenylolpropanes which antioxidants are typically applied in amounts of from 100 to 10,000 ppm. An alkaline compound, e.g. sodium hydroxide or potassium hydroxide, may also be added to increase the pH of the composition. In this case some of the acid groups of polymer may be in the form of carboxylic acid salt groups.

The invention will not be illustrated by reference to the following Examples.

EXAMPLES 1 TO 4

The lubricating oil used in these examples was a methanol ethyoxylate containing an average of 3.5 moles of ethylene oxide for each mole of methanol.

The types of anti-splashing agents used were: (1) A polymethacrylic acid. It is characterized in that a 3%w solution in water, after addition of sodium hydroxide to produce a pH of 9-10, has a viscosity in the range of from 7700-11000 centipoise (cP) (Brookfield-Viscosimeter, Spindle III, 6 rpm at 20° C.). (2) A copolymer of acrylic acid and the methyl ester of acrylic acid (about 1:1 mole). It is characterized in that a 1%w solution in water, after addition of sodium hydroxide to produce a pH of 7, has a viscosity of in the range of from 350-550 centistokes (cSt) (suspended level viscosimeter). (3) A poly(methylvinylether/maleic anhydride). It is characterized in that it has a specific viscosity of 2.6-3.5 (measured as 1g in 100 ml of methyl ethyl ketone of 25° C.). (4) A poly(methylvinylether/maleic acid). It is characterized in that a 1%w solution in water, after addition of sodium hydroxide to produce a pH of 7, has a viscosity of 175 cSt at 20° C. (suspended level viscosimeter).

Various lubricating oil compositions were prepared and details thereof are given in Table 1. The compositions were prepared by adding the anti-splashing agent and small amounts of water to the lubricating oil component and heating the mixture until a clear solution was obtained. In the case of Examples 3 and 4, 0.16%w and 0.28%w respectively of sodium hydroxide were added to the compositions.

The lubricating oil compositions were tested as coning oils by winding texturized continuous filament yarns of polyesters onto cones at a winding speed of 350 meters per minute.

The equipment used was conventional and included a steel lick roller, partly immersed in a bath of lubricating oil composition, over which the yarns passed before being would onto cones. Sheets of absorbant paper were positioned around the equipment and the number of splashes of lubricating oil composition found on the absorbant paper after 10 minutes of winding were counted. In addition the %w of coning oil composition picked up by the filaments was also determined.

The coefficients of yarn/steel friction were also determined at a winding speed of 100 meters/minute according to ASTM D 3108 (using a steel friction pin of 8 mm diameter, an angle of wrap of 180° and a measuring time of 10 minutes).

For comparative purpose the lubricating oil without the addition of an anti-splashing agent was also treated and results are reported in Table I as (a) and (b). Also for comparison a commercial mineral oil lubricating composition was also tested and results are reported in Table I as Example (c).

Table 1

| Example | Anti-splashing Agent Type | Anti-splashing Agent Amount (%w) | pH of 5%w aqueous solution | Added water[1] (%w) | oil picked up by yarn (%w) | number of splashed oil droplets | coefficient of yarn/steel friction (100 m/min) |
|---|---|---|---|---|---|---|---|
| a | — | — | 5.1 | — | 3.2 | 196 | 0.25 |
| b | — | — | 5.1 | 10 | 2.58 | 341 | 0.26 |
| 1 | 1 | 0.5 | 5.3 | 2.5 | 3.5 | 0 | 0.25 |
| 2 | 2 | 0.2 | 5.0 | 10 | 3.5 | 0 | 0.24 |
| 3 | 3 | 1.0 | 4.3 | 10 | 3.5 | 0 | 0.24 |
| 4 | 4 | 0.5 | 5.1 | 10 | 3.5 | 0 | 0.25 |
| c | — | — | 5.32 | — | 3.37 | 297 | 0.25 |

1. Amount required to obtain clear solution except for example b where water has been added for comparative purposes.
2. 5 %w of emulsion of oil in water.

EXAMPLE 5

Knitted articles of polyester were dyed under pressure at a temperature of 130° C. in an aqueous bath containing 2.4%w of a blue dye (Terasil Dark Blue RB) and 3.6%w of a pink dye (Terasil Brilliant Pink EG) on knitted articles. The knitted articles were prepared from yarns treated with the composition of Examples 2 and c. The %weight of oil on the knitted fibers before and after dyeing was determined. The results are shown in Table II.

Table II

| Example | Composition | Oil on article (%w) before dyeing | Oil on article (%w) after dyeing |
|---|---|---|---|
| 5 | Example 2 | 3.9 | 0.08 |
| d | Example c | 4.0 | 0.18 |

EXAMPLES 6 TO 9

Examples 2 to 4 were repeated using an ethanol ethoxylate containing an average of 3.5 moles ethylene oxide for each mole of ethanol and 15%w of water. The compositions had a pH (5%w aqueous solutions) of from 5 to 6. Substantially the same results were obtained.

EXAMPLES 10 TO 13

Examples 2 to 4 were repeated using a methanol ethyoxylate containing an average of 5 moles of ethylene oxide for each mole of methanol and 15%w of water. The compositions had a pH (5%w aqueous solutions) of from 5 to 6. Substantially the same results were obtained.

What is claimed is:

1. A lubricant composition comprising a major proportion of an ether of formula:

$$R - O(C_mH_{2m} - O)_xH$$

wherein

R is a $C_1$ to $C_{10}$ alkyl group, $m$ is an integer of from 2 to 4, and $x$ is an integer of from 2 to 20;

and a minor proportion of a polymer of an ethylenically unsaturated carboxylic acid.

2. A composition as in claim 1, wherein R is a $C_1$ to $C_4$ alkyl group.

3. A composition as in claim 1, wherein $x$ is from 2.5 to 10.

4. A composition as in claim 1, wherein the polymer is at least partly derived from at least one ethylenically unsaturated monocarboxylic acid having the formula:

$$C_nH_{2n-1}COOH$$

and/or at least one ethylenically unsaturated dicarboxylic acid, or an anhydride thereof, having the formula:

$$C_nH_{2n-2}(COOH)_2$$

wherein in both formulae $n$ is an integer of from 2 to 10, inclusive.

5. A composition as in claim 4, wherein the polymer is polyacrylic acid or polymethacrylic acid.

6. A composition as in claim 1, wherein the polymer is derived from an ethylenically unsaturated carboxylic acid and a $C_1$ to $C_4$ ester of an unsaturated carboxylic acid and/or a $C_1$ to $C_4$ vinyl ether.

7. A composition as in claim 1, wherein the polymer has an average molecular weight between about $4 \times 10^4$ and about $2 \times 10^7$.

8. A composition as in claim 1, wherein the amount of the polymer is from 0.01 to 5%w, based on the weight of the ether.

9. A composition as in claim 1, wherein the composition additionally comprises water in an amount from about 1.0 to about 25%w.

10. A composition as in claim 1, wherein the composition additionally comprises a corrosion inhibitor and/or an antioxidant.

11. A process for treating or oiling textile fibers comprises contacting the textile fibers with the lubricant composition of claim 1.

* * * * *